US007024352B2

(12) United States Patent
Beerends et al.

(10) Patent No.: US 7,024,352 B2
(45) Date of Patent: Apr. 4, 2006

(54) METHOD AND DEVICE FOR OBJECTIVE SPEECH QUALITY ASSESSMENT WITHOUT REFERENCE SIGNAL

(75) Inventors: John Gerard Beerends, Hengstdijk (NL); Andries Pieter Hekstra, Eindhoven (NL)

(73) Assignee: Koninklijke KPN N.V., Groningen (NL)

( * ) Notice: Subject to any disclaimer, the term of this patent is extended or adjusted under 35 U.S.C. 154(b) by 397 days.

(21) Appl. No.: 10/363,235

(22) PCT Filed: Sep. 3, 2001

(86) PCT No.: PCT/EP01/10154

§ 371 (c)(1),
(2), (4) Date: Mar. 5, 2003

(87) PCT Pub. No.: WO02/21514

PCT Pub. Date: Mar. 14, 2002

(65) Prior Publication Data

US 2003/0171922 A1 Sep. 11, 2003

(30) Foreign Application Priority Data

Sep. 6, 2000 (EP) ..... 002031094

(51) Int. Cl.
*G10L 19/00* (2006.01)

(52) U.S. Cl. ..... 704/200.1; 704/200

(58) Field of Classification Search ..... 704/200.1, 704/201, 226, 270

See application file for complete search history.

(56) References Cited

U.S. PATENT DOCUMENTS

| | | | | |
|---|---|---|---|---|
| 5,706,392 | A * | 1/1998 | Goldberg et al. | 704/200.1 |
| 6,201,960 | B1 * | 3/2001 | Minde et al. | 455/424 |
| 6,330,428 | B1 * | 12/2001 | Lewis et al. | 455/67.11 |
| 6,564,181 | B1 * | 5/2003 | Hardy | 704/201 |
| 6,609,092 | B1 * | 8/2003 | Ghitza et al. | 704/226 |

FOREIGN PATENT DOCUMENTS

| | | |
|---|---|---|
| EP | 0 648 032 | 4/1995 |
| WO | WO 96/06496 | 2/1996 |

OTHER PUBLICATIONS

Au et al, "A Novel Output Based Objective Speech Quality Measure for Wireless Communication", Proceedings of ICSP '98 Fourth International Conference on Signal Processing, Beijin, China, Oct. 12-16, 1998, vol. 1, 1998, IEEE, pp. 666-669.

Liang et al, "Output Based Objective Speech Quality", Proceedings of the Vehicular Technology Conference, New York, IEEE, vol. Conf. 44, Jun. 8, 1994, pp. 1719-1723.

* cited by examiner

*Primary Examiner*—Richemond Dorvil
*Assistant Examiner*—V. Paul Harper
(74) *Attorney, Agent, or Firm*—Michaelson & Associates; Peter L. Michaelson

(57) ABSTRACT

A method of and a device for output based objective speech quality assessment, wherein a degraded output speech signal comprising a speech information portion, is compared (5) with a reference signal retrieved from the output speech signal. The reference signal is provided by perceptual approximation of the speech information portion of the output speech signal using a speech recoder (2) producing a reference speech signal of finite bitrate. In a preferred embodiment, the speech recorder (2) is a speech codec.

23 Claims, 3 Drawing Sheets

METHOD AND DEVICE FOR OBJECTIVE SPEECH QUALITY ASSESSMENT WITHOUT REFERENCE SIGNAL

FIELD OF THE INVENTION

The present invention relates generally to speech quality assessment and, more particularly, to a method of and a device for objectively assessing the speech quality of an output signal without involving human listeners, such as an output signal received in a wireless telecommunications system and speech signals transmitted in accordance with a Voice over Internet Protocol (VoIP).

BACKGROUND OF THE INVENTION

Speech quality assessment provides for optimisation in the control and design of speech coding and transmission algorithms and equipment.

Methods of assessing speech quality involving human listener rating schemes such as, for example, the Mean Opinion Score (MOS) or the Diagnostic Acceptability Measure (DAM), provide a subjective quality measure.

This type of speech quality assessment is rather expensive and requires appropriate facilities and test equipment and conditions.

In order to avoid human listeners, objective speech measurements have been proposed, attempting to estimate or predict subjective speech quality using mathematical expressions.

Typically, objective speech quality assessment methods are based on a comparison of the clean, undistorted original input speech signal and the degraded output speech signal. However, in practice, the clean original input signal is usually not available at the output of a system or device under test.

International patent application WO-A-96/06495 proposes to analyze certain statistical characteristics of speech which are talker independent in order to determine how the output signal has been modified or distorted by a telecommunications link, for example, without requiring the clean, undistorted input signal.

For the same purpose, International patent application WO-A-96/06496 discloses to analyze, by a speech recognizer, the content of a received signal. The result of this analysis is processed by a speech synthesizer to generate a speech signal having no distortions.

International patent application WO-A-97/05730 discloses speech quality measurement using vocal tract analysis and a neural network for producing a reference signal as a replica of the clean input signal.

Speech recognition, speech synthesis and adaptation of the synthesized signal to the voice and other properties of the talker of the degraded signal, in order to provide a reference signal for comparison with the degraded speech signal for assessing the speech quality thereof, comprise in practise computationally intensive tasks with a limited accuracy.

However, it is impossible to reconstruct from the degraded speech signal a reference signal which is equal to the original input speech signal.

Further, the reference signal becomes available with a delay that prevents timely feedback for control purposes to improve speech quality if the assessed quality is below a set level.

SUMMARY OF THE INVENTION

The invention aims at overcoming intensive computational tasks and the inherent delay caused thereby in assessing output based objective speech quality.

The invention provides a novel method of output based objective speech quality assessment, wherein a degraded output speech signal comprising a speech information portion is compared with a reference signal retrieved from the output speech signal, and is characterized in that the reference signal is provided by perceptual approximation of the speech information portion of the output speech signal using a speech recoder producing a reference speech signal of finite entropy, that is providing a finite number of bits per second, i.e. bit rate.

The invention is based on the insight that by processing the distorted speech signal using a speech recoder performing a perceptual approximation with finite bitrate, the speech information portion of the degraded output speech signal is objectively reproduced in accordance with the properties of the speech recoder, providing a reference speech signal for objectively assessing the quality of the speech.

By using a speech recoder in accordance with the present invention, no extensive computer processing and computations are required for the extraction of speech parameters and the like from the output speech under test, such that no undue delays are introduced.

A speech codec (speech coder/speech decoder) is a device by which a speech signal is perceptually processed into a signal of a finite number of bits per second. Accordingly, in a preferred embodiment of the method according to the invention, the reference signal is provided by recoding the degraded output speech signal using a reference speech codec (recoder), such as a codec operative following the ITU-T G.729 standard or the ETSI 6.71 standard, for example.

The recoder should (ideally) be essentially transparent for clean, undistorted speech signals and essentially non-transparent for distorted speech signals in a degree that is a measure of the distortedness of the speech signal.

That is, if the degraded signal contains an annoying amount of background noise, for example, the recoder should "distort" the signal, e.g. by suppressing the background noise or should "degrade" the output speech signal due to the bit consumption by the noise. In the case that a speech transmission system under test is transparent, the objective quality measure should also predict such transparency, which is achieved by a recoder which is nearly transparent for a clean speech signal.

Compared to the prior art methods outlined above, the invention takes a much more pragmatic approach and focuses on the derivation of a reference speech signal from the speech information portion of the degraded output speech signal having a perceptual distance from the degraded speech signal which is a measure of the degree to which the degraded speech signal is distorted.

Accordingly, in a further embodiment of the method according to the invention, the comparison of the reference signal and the degraded output speech signal comprises calculation of the perceptual distance between the output speech signal and the reference signal.

Generally, the recoded speech signal will have a lower degree of subjective speech quality than the original input. As a perceptual distance measure, any psycho-acoustic model of human hearing can be used, such as ITU-T P.861 or PSQM99 as submitted for benchmarking by ITU-T SG12/Question 13. The perceptual distance measure can be determined with greater accuracy by adapting the perceptual measure to the type of recoder and/or vice versa. Alternatively, the perceptual distance between the degraded output speech signal and the reference speech signal can be reduced or increased by filtering off heavily distorted parts of the output speech signal or by otherwise eliminating severe distortions in the output speech signal in case the predicted quality would otherwise be too low or too high. Processing of mean values of the output speech signal and the reference speech signal may be used for reduction of the perceptual distance between these signals.

In practise, the output speech signal may be degraded in that sense that part or parts thereof have been vanished, that is the signal amplitude has been reduced to zero or essentially zero, for example. In the case of a recoder transparent to degraded speech, it will be appreciated that the reference speech signal produced will likewise reflect the vanished output speech, such that a comparison of the output speech signal and the reference speech signal will not lead to the aimed quality measure.

In a further embodiment of the method according to the invention, this problem is solved in that sense that so-called macro-properties characteristic of the output speech signal are retrieved, and wherein these macro-properties are imposed on the reference speech signal.

As will be appreciated by those skilled in the art, speech comprises a certain periodicity of the momentary energy level and sound, over intervals of some tens of milliseconds, for example. In general, a speech signal can be characterized by a number of so-called macro properties, i.e. silences, background noise, periodicity, sharp declines in the original amplitude, etcetera. By extracting these macro-properties from the output speech signal and by imposing the same on the reference signal, the part or parts of the output speech signal which have vanished, for example, or otherwise violated the macro-properties of the speech signal, can be accounted for in the reference signal. Accordingly, the subsequent comparison of the output speech signal and the reference signal will produce a quality measure which reflects the amount of degradation of the output speech signal due to the part or parts which have violated the macro-properties.

The macro-properties extracted from the output speech signal can, in a further embodiment of the method according to the invention, be imposed on the output speech signal prior to its perceptual approximation by the speech recoder. In a further embodiment of the invention the macro-properties are imposed on the output speech signal during perceptual approximation by the speech recoder. That is, while using a reference speech codec as recoder, the macro-properties can be superposed after encoding of the output speech signal and before the decoding thereof by the reference codec. In a yet further embodiment of the invention, the macro-properties are superposed on the output speech signal after its perceptual approximation, that is directly on the reference speech signal produced. Further, the macro-properties may be advantageously applied onto the degraded output speech signal for comparison with the reference speech signal produced from the degraded output speech signal.

In a simple embodiment of the invention, violations against the macro-properties of the speech signal can be accounted for by incorporating like distortions or violations in the reference speech signal, such that the same are reflected in the quality measure.

Perceptual approximation of the output speech signal can be provided in the time and/or frequency domain. In the latter case, in accordance with the invention, the output speech signal is subjected to a time-to-frequency domain transformation, and the reference speech signal is retrieved from the transformed output speech signal.

The invention further provides a device for output based objective speech quality assessment in accordance with the method disclosed above.

The method and device in accordance with the invention are particularly suitable for assessing speech quality of an output speech signal in an IP (Internet Protocol) based telecommunications network, such as VoIP or a wireless IP telecommunications network, wherein the assessed speech quality can be used for real time control and adaptation of the speech and transmission quality of the network.

The above-mentioned and other features and advantages of the invention are illustrated in the following description with reference to the enclosed drawings.

DETAILED DESCRIPTION OF THE EMBODIMENTS

Figure 1:
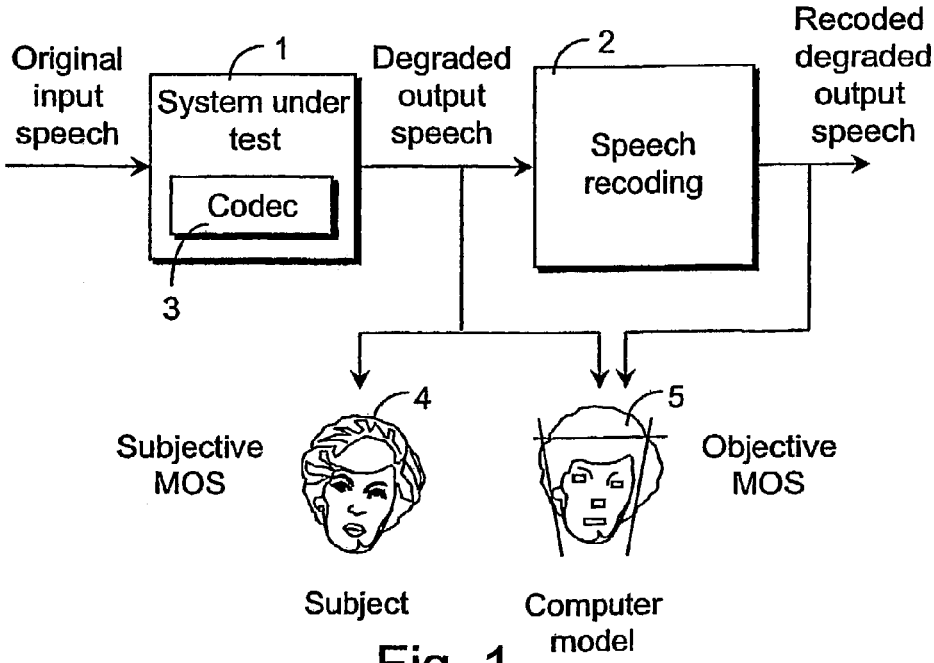
FIG. 1 shows, in a schematic and illustrative manner, the principles of output based objective speech quality assessment in accordance with the present invention.

In FIG. 1, the system under test, such as an IP (Internet Protocol) fixed or wireless telecommunication system, is generally designated by reference numeral 1. The system 1 comprises speech coding and decoding means, generally indicated as codec 3.

An original input speech signal, for example provided by a talker into a telephone terminal of a radio, wired or VoIP (Voice over Internet Protocol) operated speech communication system, is transmitted via the system 1 and received as a degraded output speech signal at another telephone terminal of the system 1. The degraded output speech signal comprises a voice or speech information portion and a noise or distortion portion.

A measure for the subjective quality of the output speech signal can be obtained from human listener rating schemes, such as the well-known Mean Opinion Score (MOS) involving human subjects 4.

An objective measure of the speech quality of the output speech signal provided by the system under test 1 can be derived from a computer model 5, modelling human subjects; illustratively referenced as objective MOS. The computer model 5 requires both data representative of the degraded output speech signal and data representative of the original input speech signal.

However, in output based objective speech quality assessment, which is the object of the present invention, data representative of the original input speech signal are not available. Therefore, reference data have to be produced for comparing with the degraded output speech signal.

In accordance with the present invention, a reference speech signal is produced by processing the degraded output speech signal using a speech recoder 2. The speech recoder 2 provides a perceptual approximation of the speech information portion of the output speech signal in the form of a reference speech signal of finite bit rate.

Figure 2:
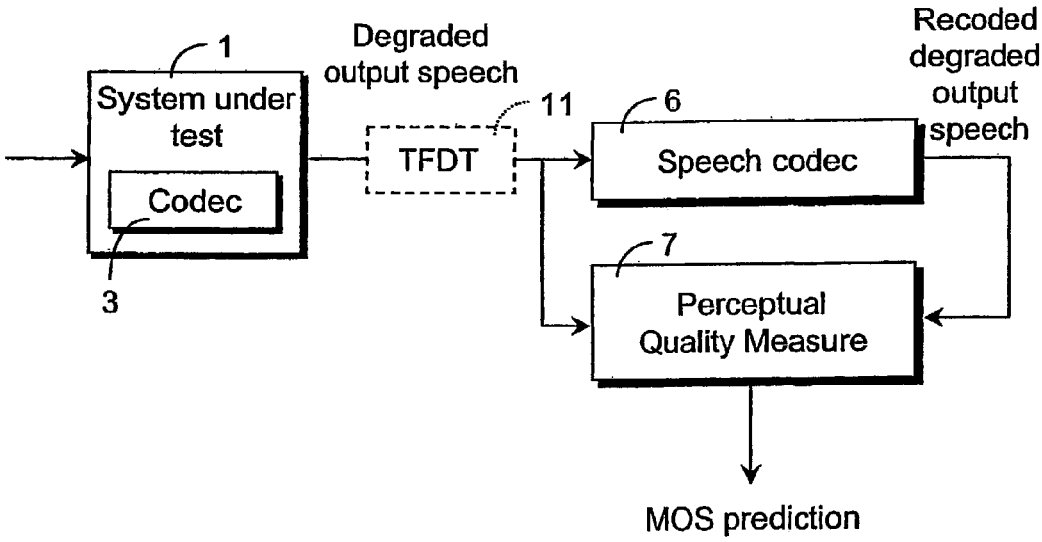
FIG. 2 shows a general block diagram of a device for output based objective speech quality assessment in accordance with the invention.

FIG. 2 shows a practical set up of an objective speech quality measurement device in accordance with the present invention, wherein the speech recoder is a reference speech codec 6, having the property of being essentially transparent for clean speech signals and essentially non-transparent for distorted speech signals in a degree that is a measure of the distortedness of the input speech signal.

The codec 6 "distorts" or "degrades" the speech signal at its input such that an amount of background noise, clicks and other distortions do not appear in the recoded signal provided. That is, the degraded output speech signal of the system under test 1, recoded by the recoder 6, results in a reference speech signal which is a representation of the speech information portion of the original clean input speech signal.

By comparing the reference speech signal with the degraded output speech signal received, using perceptual quality measurement means 7, a quality measure can be provided, resulting in a prediction of the MOS.

The reference speech codec 6 can be of any suitable type, such as a codec operative in accordance with the ITU-T G.729 or the ETSI 6.71 standard, for example.

As a perceptual quality measure any psychoacoustic model of human hearing can be used, such as ITU-T P.0.861 or PSQM99, calculating a perceptual distance measure between the recoded reference speech signal and the degraded output speech signal.

It will be appreciated by those skilled in the art that the speech recoder 2, i.e. the codec 6, are able to produce a reference speech signal without intensive computational tasks for extracting parameters and other data representative of the speech of a talker, while concurrently avoiding the inherent time delay of the prior art methods.

Processing or approximation of the degraded output speech signal for providing the reference signal and their comparison, may be provided in both the time/frequency-domain. In the latter case, the degraded output speech signal is subjected to Time to Frequency Domain Transformation (TFDT) 11, as indicated by broken lines in FIG. 2.

Figure 3:
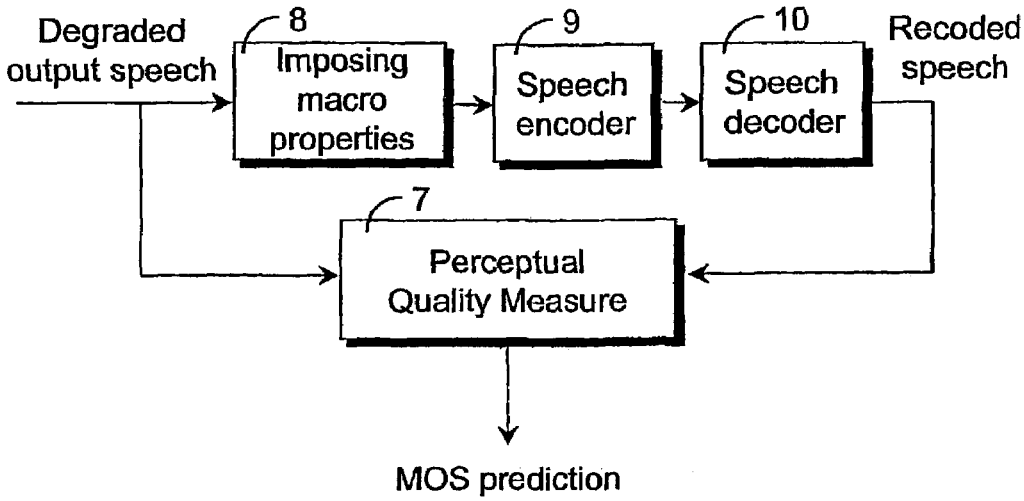
FIGS. 3–6 show block diagrams of embodiments of the device according to the invention.

FIG. 3 shows an embodiment of the invention, which accounts, for example, for an MOS prediction in the case of degraded output speech, part or parts of which have vanished, i.e. having a signal amplitude being zero or essentially zero. This is the case, for example, if the original input speech signal is temporarily muted by the system under test 1.

Means 8 are operatively connected for retrieving macro-properties from the output speech signal representative of the degree of voiceness of the output speech signal, such as natural silences, periodicity, sharp amplitude declines, background noise etcetera. The macro-properties are imposed by the means 8 on the degraded output speech signal before processing thereof by the speech recoder 2 or speech codec 6, the latter being in FIG. 3 separated in a speech encoder 9 and a subsequent speech decoder 10.

Figure 4:
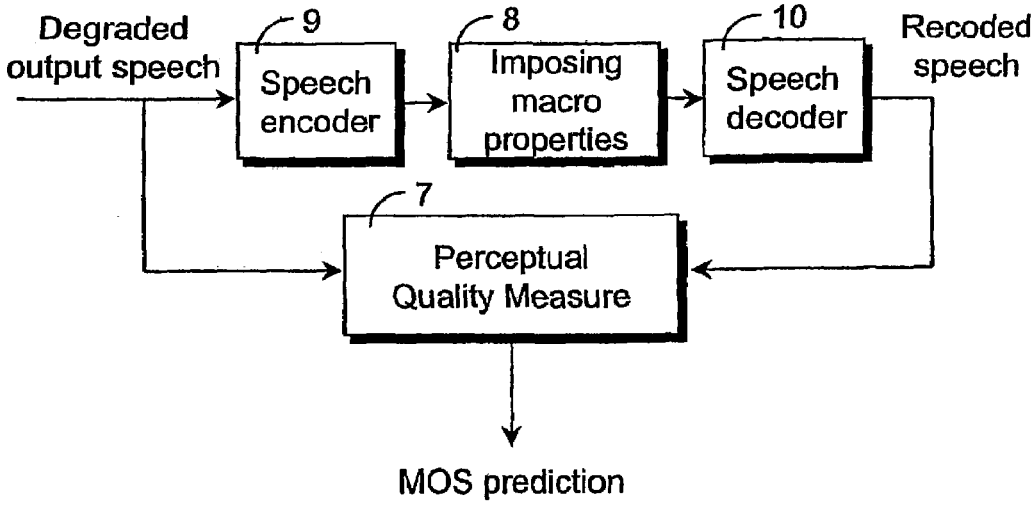

The means 8 for extracting and imposing the macro-properties may also operate in conjunction with the speech recoder 2, as shown in FIG. 4, wherein the means 8 are operatively connected between the speech encoder 9 and the speech decoder 10.

Figure 5:
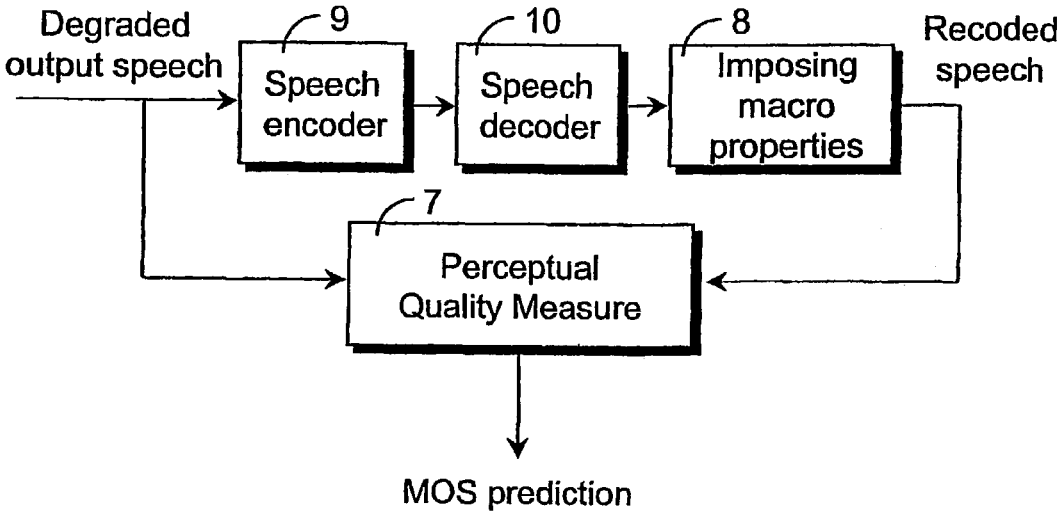

FIG. 5 shows another embodiment of the invention, wherein the means 8 are operative on the recoded reference speech signal provided by the speech encoder 9 and speech decoder 10.

Figure 6:
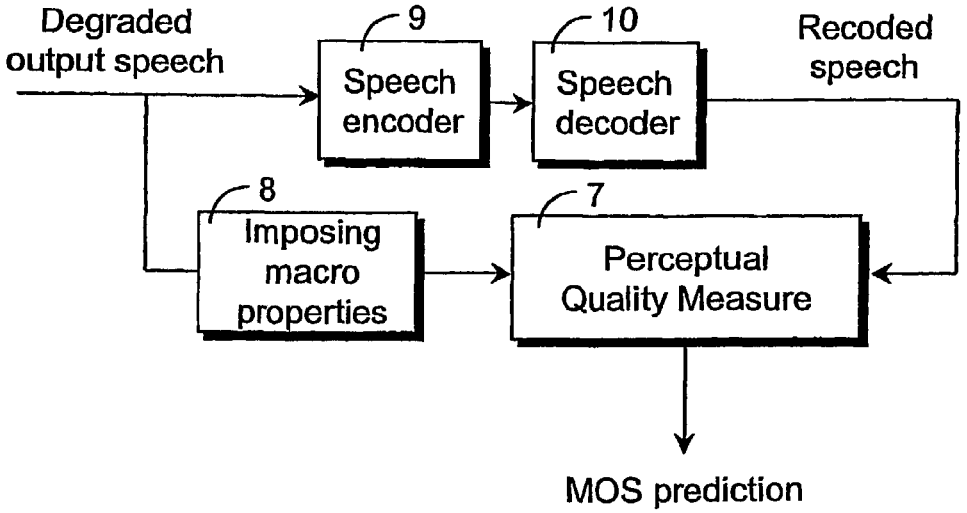

FIG. 6 shows the means 8 operatively connected in front of the means 7 for comparing the recoded speech, obtained from the degraded output speech, with the degraded output speech onto which the macro-properties have been imposed.

In a simple embodiment of the invention, violations against the macro-properties of the speech signal can be accounted for by incorporating like distortions or violations in the reference speech signal, such that the same are reflected in the quality measure (not shown).

The MOS prediction provided can be used, among others, for controlling the speech quality and/or transmission quality in a telecommunications network, such as an IP wired or wireless data telecommunications network.

From an experimental set-up, it has been verified that the method and device according to the present invention provides for a reliable output based objective speech quality assessment, in a much less complex and a much more manageable approach then the prior art methods of output based objective speech quality assessment.

What is claimed is:

1. A method of output based objective speech quality assessment, wherein a degraded output speech signal comprising a speech information portion is compared with a reference signal retrieved from said output speech signal, said reference signal being provided by perceptual approximation of said speech information portion of said output speech signal using a speech recoder producing a reference speech signal of finite bitrate.

2. A method according to claim 1, wherein said reference speech signal is provided by recoding of said output speech signal using a reference speech codec as the speech recoder.

3. A method according to claim 1, wherein said recoder is essentially transparent for clean, undistorted speech signals and essentially non-transparent for distorted speech signals in a degree that is a measure of distortedness of said reference speech signal.

4. A method according to claim 1, wherein macro-properties are retrieved representative of said output speech signal, and wherein said macro-properties are imposed on said reference speech signal.

5. A method according to claim 4, wherein said macro-properties are imposed on said output speech signal prior to said perceptual approximation.

6. A method according to claim 4, wherein said macro-properties are imposed on said output speech signal during said perceptual approximation.

7. A method according to claim 4, wherein said macro-properties are imposed on said output speech signal after said perceptual approximation.

8. A method according to claim 1, wherein macro-properties are retrieved representative of said output speech signal, and wherein said macro-properties are imposed on said output speech signal prior to said comparison.

9. A method according to claim 1, wherein said comparison comprises calculation of perceptual distance between said output speech signal and said reference signal.

10. A method according to claim 1, wherein said output speech signal is subjected to time-to-frequency domain transformation, and wherein said reference speech signal is retrieved from said transformed output speech signal.

11. A device for output based objective speech quality assessment, comprising retrieval means operatively connected for retrieving a reference signal from a degraded output speech signal, having a speech information portion, and comparator means operatively connected for comparing said output speech signal with said reference signal, and said retrieval means comprise processing means operatively connected for perceptual approximation of said speech information portion of said output speech signal using a speech recoder producing a reference speech signal of finite bitrate.

12. A device according to claim 11, wherein the speech recoder comprises a reference speech codec for providing said reference speech signal by recoding of said output speech signal.

13. A device according to claim 11, wherein said speech recoder is essentially transparent for clean, undistorted speech signals and essentially non-transparent for distorted speech signals in a degree that is a measure of the distortedness of said speech signal.

14. A device according to claim 11, comprising means operatively connected for retrieving macro-properties representative of said output speech signal, and superposition means for imposing said macro-properties on said reference signal.

15. A device according to claim 14, wherein said superposition means are operatively connected for imposing said macro-properties on said output speech signal prior to said perceptual approximation.

16. A device according to claim 14, wherein said superposition means are operatively connected for imposing said macro-properties on said output speech signal via said processing means operative for perceptual approximation of said output signal.

17. A device according to claim 14, wherein said superposition means are operatively connected for imposing said macro-properties on said output speech signal after said perceptual approximation thereof.

18. A device according to claim 14, wherein said superposition means are operatively connected for imposing said macro-properties on said output speed signal prior to comparison thereof.

19. A device according to claim 11, wherein said comparison means are operatively connected for calculating perceptual distance between said output speech signal and said reference signal.

20. A device according to claim 11, comprising transformation means for time-to-frequency domain transformation of said output speech signal, and wherein said retrieval means are operatively connected for retrieving said reference speech signal from said transformed output speech signal.

21. Use of the method according to claim 1 for assessing speech quality of an output speech signal in an IP (Internet Protocol) based telecommunications network.

22. Use of the method according to claim 21, wherein said telecommunications network is a wireless IP telecommunications network.

23. Use of the method according to claim 21 for controlling speech quality in said telecommunications network.

* * * * *